US007854663B2

(12) United States Patent
Burger

(10) Patent No.: US 7,854,663 B2
(45) Date of Patent: Dec. 21, 2010

(54) WATER AMUSEMENT RIDE

(75) Inventor: Günter Burger, Waldkirch (DE)

(73) Assignee: Mack Rides GmbH & Co. KG, Waldkirch (DE)

( * ) Notice: Subject to any disclaimer, the term of this patent is extended or adjusted under 35 U.S.C. 154(b) by 504 days.

(21) Appl. No.: 11/987,954

(22) Filed: Dec. 6, 2007

(65) Prior Publication Data

US 2008/0139328 A1 Jun. 12, 2008

(30) Foreign Application Priority Data

Dec. 8, 2006 (DE) ..... 10 2006 053 664

(51) Int. Cl.
*A63H 23/10* (2006.01)
*A63G 31/00* (2006.01)

(52) U.S. Cl. ..... 472/129; 472/13; 446/160; 114/61

(58) Field of Classification Search ..... 472/13, 472/117, 128, 129; 104/53, 69, 70; 441/35, 441/53, 65, 123, 129; 114/61, 191, 192, 114/194, 346, 363; 446/153, 156–158, 160, 446/163, 164

See application file for complete search history.

(56) References Cited

U.S. PATENT DOCUMENTS

| | | | | |
|---|---|---|---|---|
| 1,440,661 | A | 1/1923 | Dickinson | |
| 2,389,456 | A | 11/1945 | Piesch | |
| 4,516,943 | A * | 5/1985 | Spieldiener et al. | 441/35 |
| 5,299,964 | A | 4/1994 | Hopkins | |
| 5,441,454 | A * | 8/1995 | Race | 472/129 |
| 5,741,188 | A * | 4/1998 | Levin et al. | 472/128 |
| 5,989,126 | A * | 11/1999 | Kilbert et al. | 472/13 |
| 6,561,914 | B2 * | 5/2003 | Henry | 472/13 |
| 6,808,457 | B1 * | 10/2004 | Paukert et al. | 472/14 |

* cited by examiner

*Primary Examiner*—Kien T Nguyen
(74) *Attorney, Agent, or Firm*—The Nath Law Group; Jiaxiao Zhang; Jerald L. Meyer

(57) ABSTRACT

The water amusement ride according to the invention has watercraft that are pulled through the body of water (1) on a traction cable (40). These watercraft are composed of a frame (10), pulled by the traction cable (40), on which a float (20) having a platform (24) is rotatably supported and on the underside of which is provided with a blade wheel (30). When the watercraft is moved through the body of water (1) in the direction of the arrow (A), the blade wheel (30) together with the float (20) are set in rotational motion by the resulting flow.

14 Claims, 3 Drawing Sheets

WATER AMUSEMENT RIDE

The invention relates to a water amusement ride comprising a watercraft which is moved in a body of water and which has a float borne by the water.

Such a water amusement ride is known from DE 10 2004 062 315 A1. The float borne by the water is connected in an articulated manner to a chassis, which is guided on rails situated at the bottom of the water, in such a way that the float is able to perform limited transverse or lifting motions with respect to the chassis. The chassis is preferably pulled through the body of water by means of a traction cable led over guide rollers.

A water amusement ride, referred to as a round boat ride, is known from DE 20 2005 018 045 U, in which floats having a circular horizontal projection move through a channel. The floats which carry passengers are moved by flow pumps or by flow generated by the natural hydraulic gradient of the channel. Contact with the channel walls imparts angular momentum to the floats which results in an uncontrolled, random rotation of the watercraft.

Proceeding from this prior art, the object of the present invention is to provide a water amusement ride in which the described rotational motion is produced without contacting channel walls.

This object is achieved according to the present invention by the fact that on a frame a float is provided which is rotatable with respect to the frame and has seats for accommodating passengers, and on the underside of the float a blade wheel is fixedly connected thereto in such a way that the float is set in rotational motion as it travels through the body of water.

According to the proposal stated in claim 2, the float has a circular platform similar to the watercraft known from DE 20 2005 018 046 U. The blade wheel connected to this platform is oriented coaxially thereto, the blades of the blade wheel projecting perpendicular to the direction of travel.

When the watercraft is moved through the body of water, the resulting flow imparts a rotational motion to the blade wheel and thus to the float.

Advantageous designs of the blades of the blade wheel are stated in claims 3 and 4.

According to the proposal stated in claim 5, a displaceable guide plate is associated with the blade wheel, by means of which the rotational direction and/or rotational speed of the blade wheel may be influenced. As stated in claim 6, the guide plate may be composed of a panel that is rotatably mounted parallel to the periphery of the blade wheel, and according to claim 7 the panel is connected to an actuator shaft which coincides with the blade wheel axis and which on its end situated in the passenger compartment has a handle, preferably a control lever or control wheel, for manually adjustment by a passenger.

According to the proposal stated in claim 8, however, the guide plate may also be automatically adjusted as a function of the path of the watercraft, for example according to claim 9, by use of a control curve associated with the path.

The rotational direction and optionally also the rotational speed of the blade wheel are modified by rotating the guide plate in one direction or the other.

As known in principle from DE 10 2004 062 315 A1, either the traction cable conveying device characterized in claim 10 or the flow drive characterized in claims 11 through 13 is provided for driving the watercraft.

The flow pumps proposed in claim 11, in the form of injection pumps according to claim 14, may also be used for controlling the rotational direction and rotational speed of the blade wheel and thus of the float connected thereto.

The subject matter of the invention is explained in detail below with reference to one preferred exemplary embodiment illustrated in the drawings, which show the following:

Figure 1:
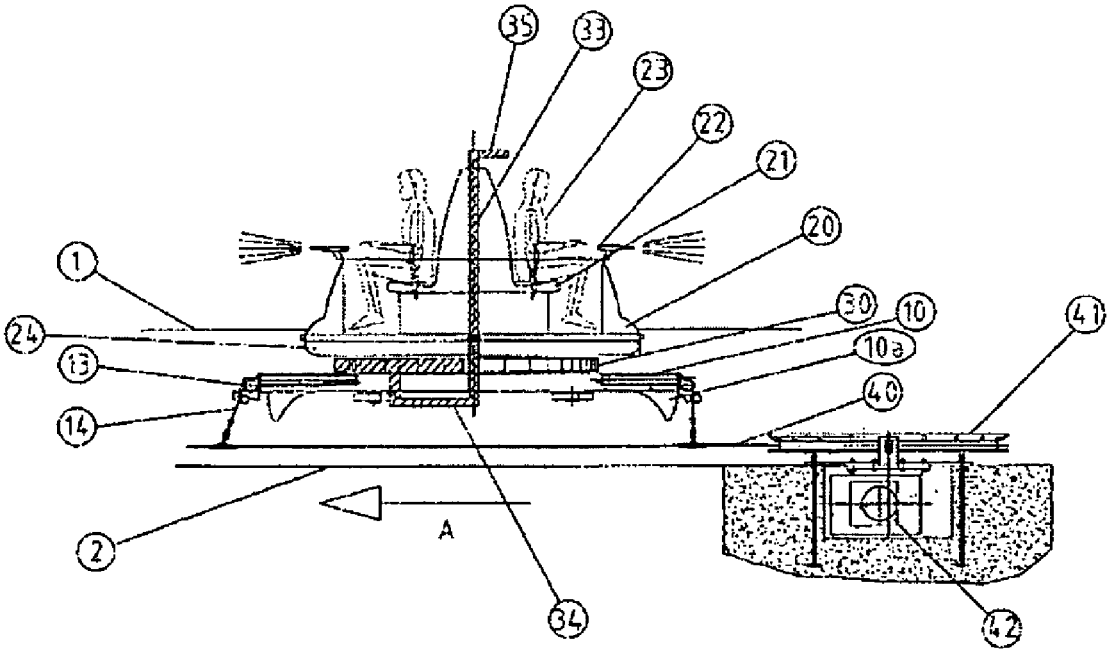
FIG. 1 shows a partial sectional side view of a watercraft according to the invention in the body of water.
Figure 2:
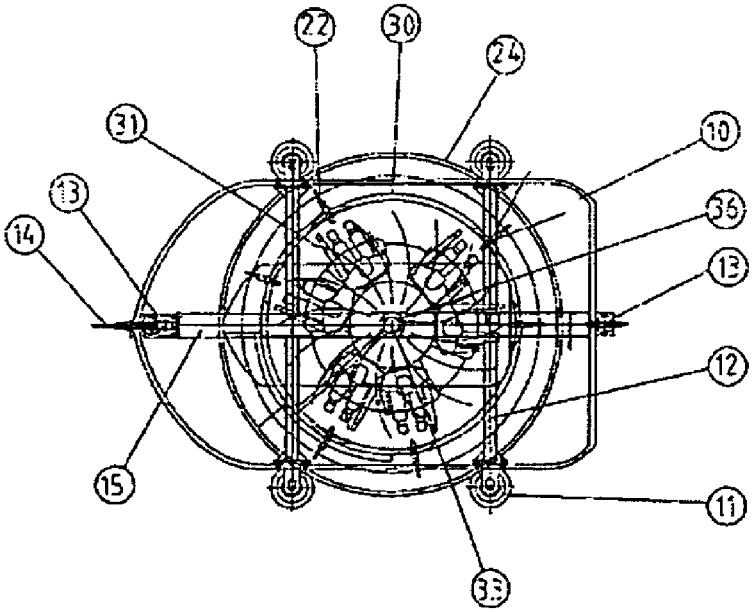
FIG. 2 shows a top view of the watercraft according to FIG. 1.

FIGS. 1 and 2 show the basic design of the water amusement ride comprising a watercraft according to the invention. The watercraft is essentially composed of a frame 10 which is provided on its underside with guide fins 10*a* and on which the rotatable float 20 is mounted. This rotatable float 20 has a circular disk-shaped platform 24 on which the seats 21 for the passengers 23 are mounted. Water spray guns 22 are provided in front of the seats.

On the underside of the platform 24, located in the water, is provided a blade wheel 30 which is connected to the platform in a rotationally fixed manner and which has a design as shown in FIGS. 5 through 8, to be described in greater detail below.

To move the watercraft through the body of water 1 a traction cable 40 is provided in the body of water and is led via guide rollers (not illustrated), anchored at the water bottom 2, corresponding to the planned route for the watercraft. The traction cable 40 is driven by a geared motor 42 via the cable pulley 41. The frame 10 of the watercraft is connected to this traction cable 40 via cable couplings 13 and connecting cables 14. When the watercraft moves by means of the traction cable 40 in the direction of the arrow A, the resulting flow sets the blade wheel 30 and thus the float connected thereto in rotation.

Figure 3:
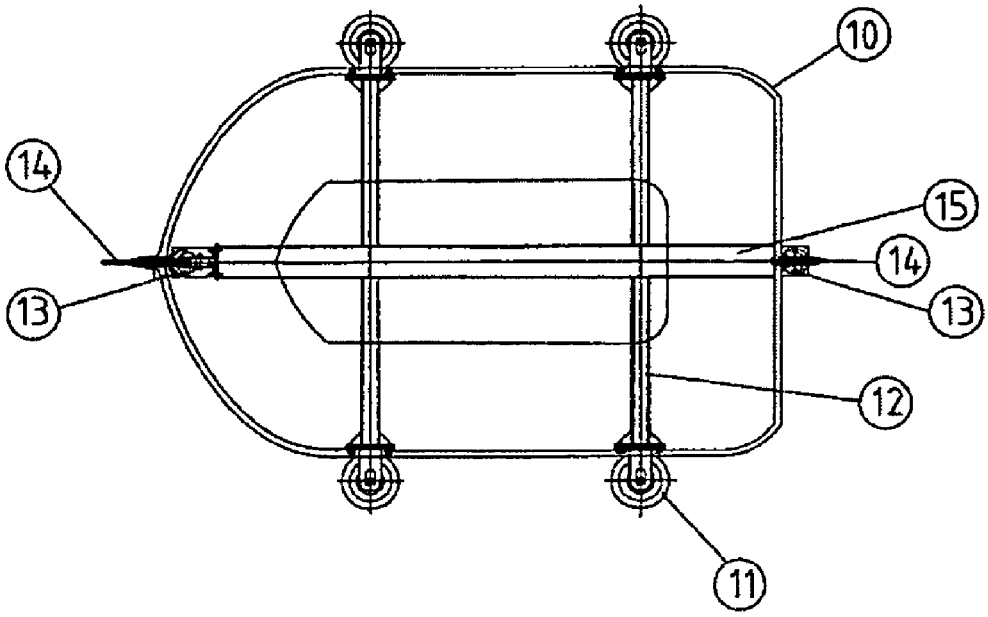
FIG. 3 shows a bottom view of the frame, without the blade wheel.

Transverse braces 12 and a longitudinal brace 15 are provided for stabilizing the frame 10, as shown in greater detail in the bottom view according to FIG. 3. Lateral support rollers 11 are rotatably mounted on the outer ends of the transverse braces 12 which ensure gentle docking of the watercraft at the station landing platform. At the front and rear ends of the longitudinal brace 15 are located cable couplings 13 in which the connecting cables 14 connected to the traction cable 40 are suspended.

Figure 4:
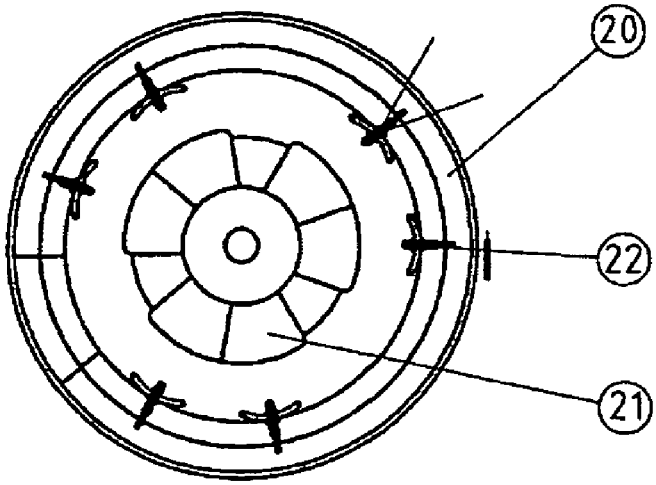
FIG. 4 shows a top view of the upper portion, without passengers.

The design of the rotatable float 20 together with seats 21 and spray guns 22 is shown in detail in FIG. 4.

Figure 5:
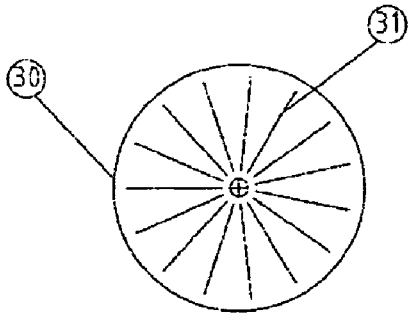
FIG. 5 shows a bottom view of the blade wheel according to a first exemplary embodiment.
Figure 6:
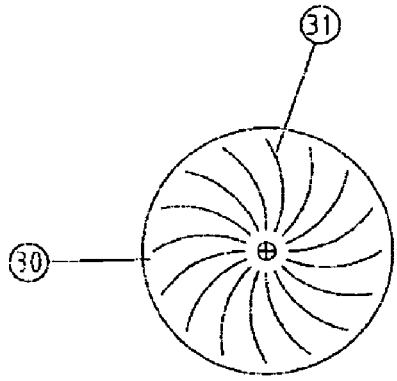
FIG. 6 shows a bottom view of the blade wheel according to a second exemplary embodiment.
Figure 7:
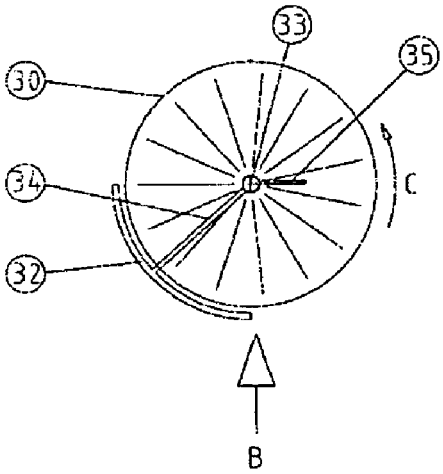
FIG. 7 shows a bottom view of the blade wheel according to FIG. 5, with the panel in a first position.
Figure 8:
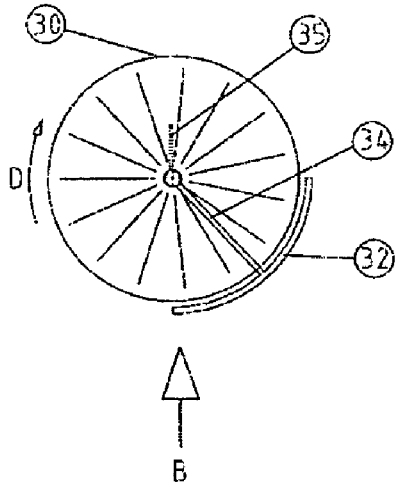
FIG. 8 shows a bottom view of the blade wheel with the panel in a second position.

Two structural designs illustrated in FIGS. 5 and 6 are proposed for the design of the blade wheel.

The blade wheel 30 according to FIG. 5 has radially and linearly extending blades 31.

FIG. 6 illustrates a more efficient blade wheel 30', the radially extending blades 31' of which are curved in an arch.

For influencing the rotational direction and rotational speed of the blade wheel 30, a panel 32 is provided which extends over a sector of approximately 80° on the exterior of the blade wheel 30. This panel covers a portion of the chambers of the blade wheel. The panel is connected via the panel support 34 to the actuator shaft 33, which is guided upward into the passenger compartment through the center axis 36 of the blade wheel 30 and of the float 20, and which on its outer end has a control lever 35. By use of this control lever 35 the passengers 22 may change the position of the panel, for example by swiveling it from the position illustrated in FIG. 7 to the position illustrated in FIG. 8. For constant flow in the direction of the arrow B, this causes the blade wheel 30, and thus the float 20 connected thereto, to revolve first in direction C, i.e., in the counterclockwise direction, and then after adjustment, in the direction of the arrow D, i.e., in the clockwise direction. Changing the position of the panel affects the rotational speed in such a way that by use of this adjustable panel the passenger may interactively intervene in the course of travel, which contributes to additional appeal of the water amusement ride.

LIST OF REFERENCE NUMERALS

1 Body of water
2 Water bottom
10 Frame
10*a* Guide fins
11 Support rollers
12 Transverse braces
13 Cable coupling
14 Connecting cable
15 Longitudinal brace
20 Rotatable float
21 Seats
22 Spray guns
23 Passengers
24 Platform
30, 30' Blade wheel
31, 31' Blades
32 Guide plate, panel
33 Actuator shaft
34 Panel support
35 Control lever
36 Blade wheel axis
40 Traction cable
41 Cable pulley
42 Geared motor
A Conveying direction, direction of travel
B Flow direction
C, D Rotational directions of the blade wheel

The invention claimed is:

1. Water amusement ride comprising a watercraft which is moved in a body of water and has a float, borne by the water, having seats (21) for accommodating passengers, characterized in that the float (20) is rotatably supported on a frame (10), and on the underside of the float (20) a blade wheel (30) is fixedly connected thereto in such a way that the float (20) is set in rotational motion as it travels through the body of water (1).

2. Water amusement ride according to claim 1, characterized in that the float (20) has a circular platform (24), and the blade wheel (30) connected to the float (20) is oriented coaxially to the platform (24), blades (31, 31') of the blade wheel (30) projecting perpendicular to the direction of travel (A).

3. Water amusement ride according to claim 2, characterized in that the blades (31) extend radially.

4. Water amusement ride according to claim 3, characterized in that the blades (31') are curved in an arch.

5. Water amusement ride according to claim 1, characterized in that an adjustable guide plate (32) is associated with the blade wheel (30) which influences the rotational direction and/or rotational speed thereof.

6. Water amusement ride according to claim 5, characterized in that the guide plate is composed of a panel (32) that is rotatably mounted parallel to the periphery of the blade wheel (30).

7. Water amusement ride according to claim 6, characterized in that the panel (32) is connected to an actuator shaft (33) which coincides with the blade wheel axis (36) and which on its end situated in the passenger compartment has a handle, preferably a control lever (35) or control wheel.

8. Water amusement ride according to claim 5, characterized in that the guide plate is externally controllable as a function of the path of the watercraft.

9. Water amusement ride according to claim 8, characterized by a control curve associated with the path of the watercraft for adjusting the guide plate.

10. Water amusement ride according to claim 1, characterized in that the frame (10) is connected to a traction cable (40) which is led by guide rollers situated in the body of water (1) and is pulled by a motor-driven cable pulley (41).

11. Water amusement ride according to claim 1, characterized in that flow pumps are provided in the body of water (1) which generate a flow which is used to drive the float.

12. Water amusement ride according to claim 11, characterized in that the body of water is designed as a channel.

13. Water amusement ride according to claim 1, characterized in that the body of water is designed as a channel with a hydraulic gradient.

14. Water amusement ride according to claim 1, characterized in that injection pumps are provided in the body of water in the vicinity of the path of the watercraft which generate a flow which influences the rotational direction and/or speed of the blade wheel.

* * * * *